US008209892B2

(12) United States Patent
Nielsen

(10) Patent No.: US 8,209,892 B2
(45) Date of Patent: Jul. 3, 2012

(54) GIFTWEAR GREETING CARD AND PACKAGING

(75) Inventor: Jennifer Nielsen, Arlington, VA (US)

(73) Assignee: Wine Wear, Inc., Arlington, VA (US)

( * ) Notice: Subject to any disclaimer, the term of this patent is extended or adjusted under 35 U.S.C. 154(b) by 755 days.

(21) Appl. No.: 12/384,595

(22) Filed: Apr. 7, 2009

(65) Prior Publication Data

US 2010/0252460 A1 Oct. 7, 2010

(51) Int. Cl.
*G09F 3/00* (2006.01)

(52) U.S. Cl. ..... 40/310; 40/599; 40/124.08

(58) Field of Classification Search ..... 40/310, 40/539, 306, 124.14, 124.08; 229/116.1, 229/922; 215/11.1, 11.6, 386; 150/154
See application file for complete search history.

(56) References Cited

U.S. PATENT DOCUMENTS 1,473,313 A * 11/1923 Piatt ..... 40/310
2,007,685 A * 7/1935 Lyle ..... 40/310
2,184,846 A * 12/1939 Olsen ..... 40/310
5,137,207 A * 8/1992 McAdam ..... 229/116.3
6,612,059 B2 * 9/2003 Cochran et al. ..... 40/673
D499,309 S * 12/2004 Hicks ..... D7/625

FOREIGN PATENT DOCUMENTS

JP 2002055611 A * 2/2002

* cited by examiner

*Primary Examiner* — Casandra Davis

(57) ABSTRACT

A personally crafted greeting card adapted to insert over a gift is disclosed. The greeting card includes a top horizontal panel and two vertical panels. The top horizontal panel is adhered to the vertical panels by means of adhesive tapes to form a receptacle for inserting over a gift. The vertical panels are designed in T-shirt shape including front and back surface for inputting personalized messages over it for imparting a personal touch while presenting the gift to a recipient. The greeting card is inserted over the neck of a wine or other spirit bottle, or gifts with similar neck configurations through a cutout orifice formed at the center of the top horizontal panel in the unfolded position. The invention includes a packaging system for holding the greeting cards in their greeting card covers. The packaging system includes a crate for holding a plurality of greeting cards in their greeting card covers.

18 Claims, 5 Drawing Sheets

GIFTWEAR GREETING CARD AND PACKAGING

FIELD OF THE INVENTION

The present invention relates generally to a greeting card. More particularly, the invention relates to a personally crafted greeting card placed over the neck of a wine or other bottle, or another article with a similar neck configuration, when given as a gift.

BACKGROUND OF THE INVENTION

In many cultures, it is customary either to send or personally hand a greeting card along with a gift on special occasions such as birthdays, weddings, anniversaries, holidays, religious and other celebrations, to a member of the family, friend, neighbor, or others as a gesture of affection, or as a token of appreciation for services rendered by strangers.

Greeting cards of the type commercially available are well known in the art. Typically, the commercially available greeting cards have generic personal messages written on the cover or inside the pages of the card. The presenter of the gift wishing to convey their own personal messages are left with the choice of using a blank commercial greeting card or to create one on their own. Such cards are usually tagged on to the gift, over the gift wrapper, or handed separately along with the gift.

A gift of wine or other spirits is popular especially during the holidays. Gift wrapping a wine bottle presents a special challenge. Traditionally, wine as a gift has been presented without a gift wrap or ensconced in a gift bag especially made to hold a wine bottle. If the presenter wishes to give a greeting card along with the bottle of wine, it is handed separately. On those occasions, there is a tendency to leave the card behind and grab the wine bottle by the neck or in a bag in the hustle and bustle of heading out to the party.

Thus, there is a need in the art for a personalized greeting card that stays in place on a wine bottle while transporting and presenting the gift of wine to the person for whom the gift is intended. The present invention fulfills that need with a greeting card that can be placed over the neck of a wine or other bottle, or an article with a similar neck configuration and with a personalized message imprinted on the surface of the card that the person receiving the gift can immediately see and appreciate.

The simplicity of the greeting card design of the present invention and the loosely fitting manner in which it drapes around the body of the wine bottle, makes it possible for the recipient to see the label of the wine and thus the type and quality of wine presented without going through the tedious motion of unwrapping a wine bottle that may be wrapped with wrapping paper held together with tape. In addition, the greeting card worn by the wine bottle conveys the special personalized greeting the presenter wishes to convey to the family member, friend or the host as the case may be.

These and other features and advantages of the present invention will become obvious to one skilled in the art through the summary of the invention, brief description of the drawings, detailed description of the invention, and the appended claims.

SUMMARY OF THE INVENTION

The present invention relates to a personally crafted greeting card with an orifice capable of being placed over the neck of a wine or other bottle, or other article with a similar neck configuration when given as a gift. The object of the invention is to provide an alternative to the currently available generic greeting cards that are customarily handed separately or taped to the surface of a gift-wrapped gift. In the case of a wine or other bottle given as a gift, the current generic cards may be taped over the bottle as such or if wrapped in gift wrap, taped over the surface of the wrap. The present invention is an attractive alternative to this method of gifting wine or other spirits by providing a personally crafted gift card that can be slid over the neck of a wine or other spirit bottle, or other articles with a similar neck configuration.

In an exemplary embodiment of the present invention, the greeting card is composed of a top horizontal detachable panel with an orifice and at least two vertical panels. In this embodiment, the greeting card of the present invention is draped over the body of the wine or other bottle by inserting the orifice on the horizontal top panel through the neck of the bottle or other article with a neck configuration. The top horizontal panel is attached to the top sections of the two vertical panels using a pressure sensitive adhesive tape, cellophane tape, or glue.

In one embodiment of the present invention, the vertical sections may be in the shape of a T-shirt, shirt, or other garment.

In yet another embodiment of the present invention, the orifice formed on the top horizontal panel is further provided with multiple relief cuts. The multiple relief cuts enable easy insertion of the greeting card through the neck of the gift bottle or other article without the formation of tears on the panel during insertion.

In one embodiment of the present invention, a personal message is imprinted or in the case of a blank card hand written on one or more outside surfaces of the vertical panels of the greeting card and immediately visible to the person receiving the gift. This is an improvement over a generic card where the person has to open the envelope to see the greeting conveyed by the presenter.

In another embodiment of the present invention, the recipient of the gift is able to see the wine label through the openings on either side of the card draped over the wine bottle without having to tear apart gift wrapping.

In yet another embodiment of the present invention, a packaging system is provided for holding the greeting cards. In this embodiment, the packaging system is composed of a greeting card cover for holding the greeting card along with a crate for holding a plurality of greeting cards in their covers for display. In this embodiment, the greeting card covers present the sentiments or messages displayed on the side panels of the greeting cards thus making it easier for the customer to choose a preferred card without having to take the card out of its cover.

BRIEF DESCRIPTION OF THE DRAWINGS

The present invention will be more fully understood through the accompanying drawings in conjunction with the detailed description that follows.

The ensuing drawings of the present invention are for illustrative purposes only and should not be construed to limit the scope of the invention.

DETAILED DESCRIPTION OF THE INVENTION

The present invention discloses a personally crafted greeting card with an orifice that can be inserted over the neck of a wine, or other bottle, or other gift articles that have a similar neck configuration. The configuration of the assembled personalized greeting card allows for it to be worn and displayed on the body of the wine, or other bottle, or article of gift in the manner of a T shirt or other garment of choice, presenting an attractive alternative to a generic commercial greeting card.

Figure 1A:
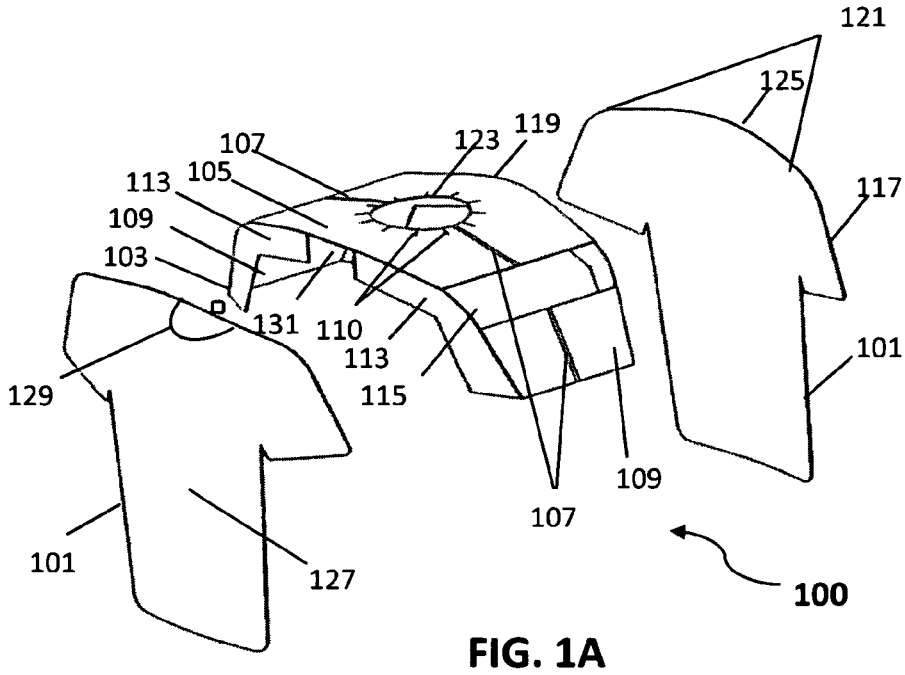
FIG. 1A is a block diagram illustrating a fragmented perspective view of the greeting card in accordance with an exemplary embodiment of the present invention.

Referring now to the drawings, FIG. 1A is a fragmented perspective view of a greeting card 100 in accordance with an exemplary embodiment of the present invention. The greeting card 100 includes a top horizontal panel 103 and multiple vertical panels 101. The top horizontal panel 103 facilitates integration of the vertical panels 101 resulting in construction of a complete greeting card (as shown in FIG. 2). The top horizontal panel 103 is flexible and foldable and may be divided into two sections, which are a foldable curved section 105 and a foldable slant section 109. A major axis, 107 traverses through the middle of sections 105 and 109. The foldable curved section 105 and the foldable slant section 109 of the top horizontal panel 103 are separated by a section 115 which helps to easily fold the curved and slant sections. In another embodiment of the present invention, the foldable curved section 105 may have an arched, or flat shape.

In an exemplary embodiment of the present invention, the top horizontal panel 103 additionally comprises a series of perforations (not shown in FIG. 1A.) along the major axis 107. The perforations allow the curved section 105 and the slant section 109 to be easily folded and unfolded at the major axis 107.

Referring again to FIG. 1A, the curved top section 105 on the horizontal panel 103 has a cutout orifice 123 employed at the center. The cutout orifice 123 may be either, circular, rectangular or square. The diameter of the circular cutout orifice 123 may be in a range from one inch to three inches to fit bottle neck diameters in the same range. The length of the border on each side of the circular, rectangular, square, or triangular cutout orifice 123 may be in the range of one inch to four inches. The cutout orifice 123 includes multiple relief cuts 110 at the inside contour of the cutout orifice 123. The multiple relief cuts 110 of the cutout orifice 123 are expandable, enabling the insertion of the top horizontal panel of the assembled greeting card through bottle necks of varying sizes, preventing tearing of greeting card 100 around the cutout orifice 123. For instance, the multiple relief cuts 110 on a cutout orifice 123 of an inch diameter may enable the greeting card to be inserted over a bottle with a one and a half inch diameter neck. In another embodiment of the invention, the cutout orifice may be formed with a circular wavy pattern around the inner diameter of the orifice without the need for the multiple relief cuts for easy insertion over a bottle, or other gifts with similar neck configuration.

The top horizontal panel 105 of the greeting card 100 consists of multiple adhesive tapes 113 (the adhesive tapes at the rear end are not displayed in FIG. 1A), which are extended out from the circumference of the top horizontal panel 105. The adhesive tapes 113 may be a pressure sensitive adhesive tape, cellophane tape, or an object enabled to employ an adhesive material such as glue. The pressure sensitive adhesive tape 113 may be appropriately adhered to the external object, for instance, T-shirt shaped vertical panels 101. If the adhesive tapes 113 are non-pressure sensitive adhesive tapes, a layer of appropriate adhesive material may be applied over the foldable curved section 105 and foldable slant section 109 and may be adhered to external objects thereafter. The adhesive tapes 113 is adapted to perform a bridging function between the foldable curved section 105 and foldable slant section 109 resulting in an integrated top horizontal panel 103. In one embodiment of the present invention, the adhesive tapes 113 which are extended at the foldable curved section 105 and the foldable slant section 109 are separated, by a space 131 at the middle side of the top horizontal panel 103. The separation may be useful to create ease of use and tolerance when affixing the top horizontal panel 103 with the vertical panels 101.

Referring now to the vertical panels 101 in FIG. 1A, the panels comprise of a curved top section 125, a slant top section 117 and a front surface and/or a back surface 127. In one embodiment of the present invention, the vertical panels 101 are in a T-shirt shape, the curved top section 125 is the shoulder of the T-shirt and the slant top section 117 the arm of the T-shirt. The neck portion 129 of the T-shirt shaped vertical panels 101 may be one of a V-shaped neck, U-shaped neck, flat neck, or straight neck. The front surface and the back surface 127 of each vertical panel 101 may be used for displaying at least one of a graphics or a text message for an event. The text messages are either printed text messages or handwritten text messages depicting a slogan, emblem, or sentimental wishes for an event. Alternately, the graphics may be an image, a landscape, a design, a printed box with texts, or a writeable box.

In an exemplary embodiment of the present invention, the horizontal top panel 103 with foldable curved section 105 aligns with the curved top section 125 of the vertical panels 101 and the foldable slant section 109 of the top horizontal panel 103 aligns with the top slant section 117 of the vertical panels 101 allowing the sections to adhere together with the pressure sensitive adhesive tapes to create a smooth flawless structured greeting card 100.

In one embodiment of the present invention, the greeting card 100, comprising the vertical panels 101 and the top horizontal panel 103 are made of at least one of a cardboard paper, reinforced cloth, or flexible plastic material. The top horizontal panel 103 is printable and adapted to include various forms of graphics such as, but not limited to, computer implemented designs, pictures, landscapes, solid colors, mixed colors, abstract designs, and hand-drawn illustrations.

According to an exemplary embodiment of the present invention, the elements of the greeting card, the top horizontal panel 103 with foldable curved section 105 and foldable slant section 109, cutout orifice 123, multiple relief cuts 110, section 115, the vertical panels 101, and the neck section 129 are all made by die-cutting a the paper cardboard, flexible plastic, reinforced cloth, or other suitable material.

Figure 1B:
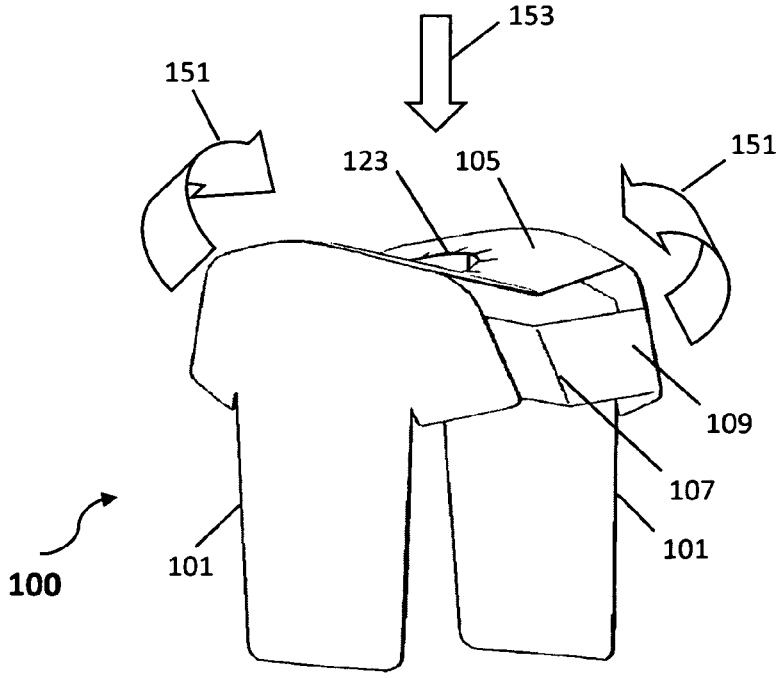
FIG. 1B is a block diagram illustrating a perspective view of the greeting being assembled in accordance with an exemplary embodiment of the present invention.

Referring now to FIG. 1B, the assembling and folding process of the various elements of the greeting card are shown in a perspective view of an exemplary embodiment of the present invention. The greeting card 100 comprising the top horizontal flat panel 103 affixed to the vertical panels 101 by means of pressure sensitive adhesive tapes, glue or cellophane tape is moved inwardly in a direction 153 resulting in a downward movement 157 of the foldable curved section 105 of the top horizontal panel 103 and an inward movement of the foldable slant section 109 of the top horizontal panel 103 along the perforations of the major axis 107 resulting in a collapsed greeting card which can be put away in its greeting cover.

Figure 2A:
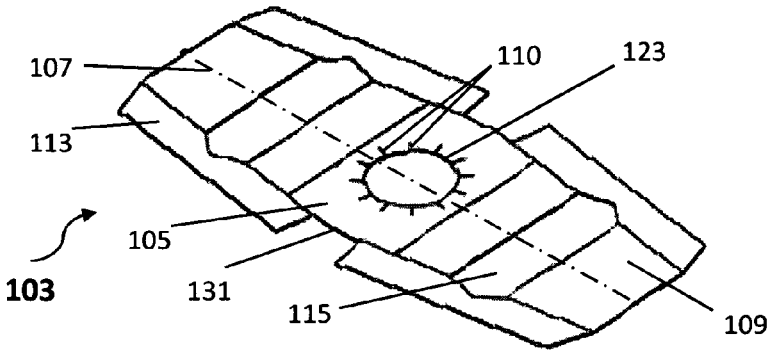
FIG. 2A is a block diagram illustrating the top horizontal panel of the present invention in the initial collapsed configuration before assembly in accordance with an exemplary embodiment of the present invention.

FIG. 2A shows a top plan view of the top horizontal panel 103 in its flat position in accordance with an exemplary embodiment of the present invention illustrating the essential parts of the panel. The cutout orifice 123 with multiple relief cuts 110 facilitates the insertion of bottle necks of various diameters. Adhesive tape 113 scans the length of the top horizontal top panel 103 on either side with an open section 131 on either side. The open section 131, the major perforated axis 107, and foldable section 115 facilitate easy folding of the curved top section 105 and the slanting section 109.

Figure 2B:
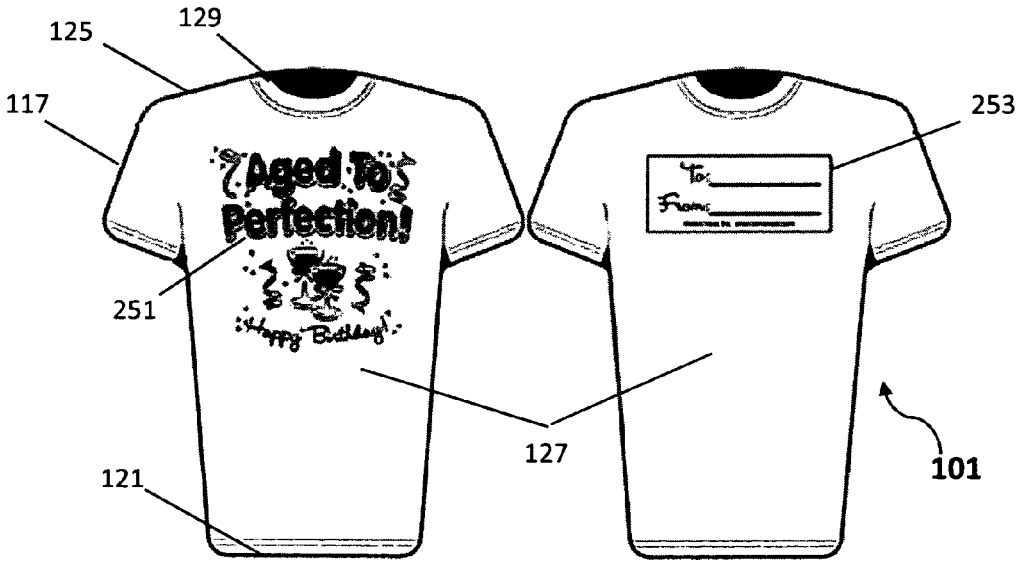
FIG. 2B is a block diagram of an exemplary embodiment of the present invention showing two frontal views of the vertical panels with illustrations of a pre-printed greeting message on one panel and space to enter a personal message on the other.

Referring now to FIG. 2B, a front-view of the T-shirt shaped vertical panels 101 is illustrated in accordance with an exemplary embodiment of the present invention. The vertical panel comprises a front surface and a back surface as well as a neck section 129, shoulder sections 125 and arm sections 117. The front surface 127 of the vertical panel 101 displays the graphic, pre-printed pictures of landscapes, photographs, slogans, sentiments, wishes 251 or in the alternative provides a space 253 to enter handwritten wishes to the recipient of the greeting card along with the gift. The presenter may create various hand-drawn illustrations of their choice in lieu of the pre-printed graphics. Alternatively, a presenter can affix an external adhesive based object having various designs or graphics on the vertical panels of the greeting card. The landscape scenes, photographs or the box to enter the wishes may be generated using computer integrated printing devices or non-computer integrated devices. The graphics may also be customized for a particular business or organization. As apparent to those skilled in the art several types of graphics, design or text in various shapes & colors may be generated and are envisioned within the scope of present invention.

It should be noted that T-shirt shaped vertical panels are shown for illustrative purposes only and may be replaced with panels of other configuration. For instance, a rectangular, a square, a circular, or a semi-circular shaped vertical panel 101 may also be employed in construction of the greeting card. The T-shirt shaped vertical panels 101 may include a neck section 129, a curved shoulder section 125, and a slanting arm section 117 and a bottom section 121. The neck section 129 may be printed with a U shaped or V shaped design including straight or flat strips. The size of the vertical panel 101 may vary without diverging from the scope of the present invention. For instance, the length of the vertical sections may be from 3" to 10" or more. Similarly, the upper breadth and length and the lower breadth and length of the vertical sections may vary from 2" to 7" or more.

Figure 3:
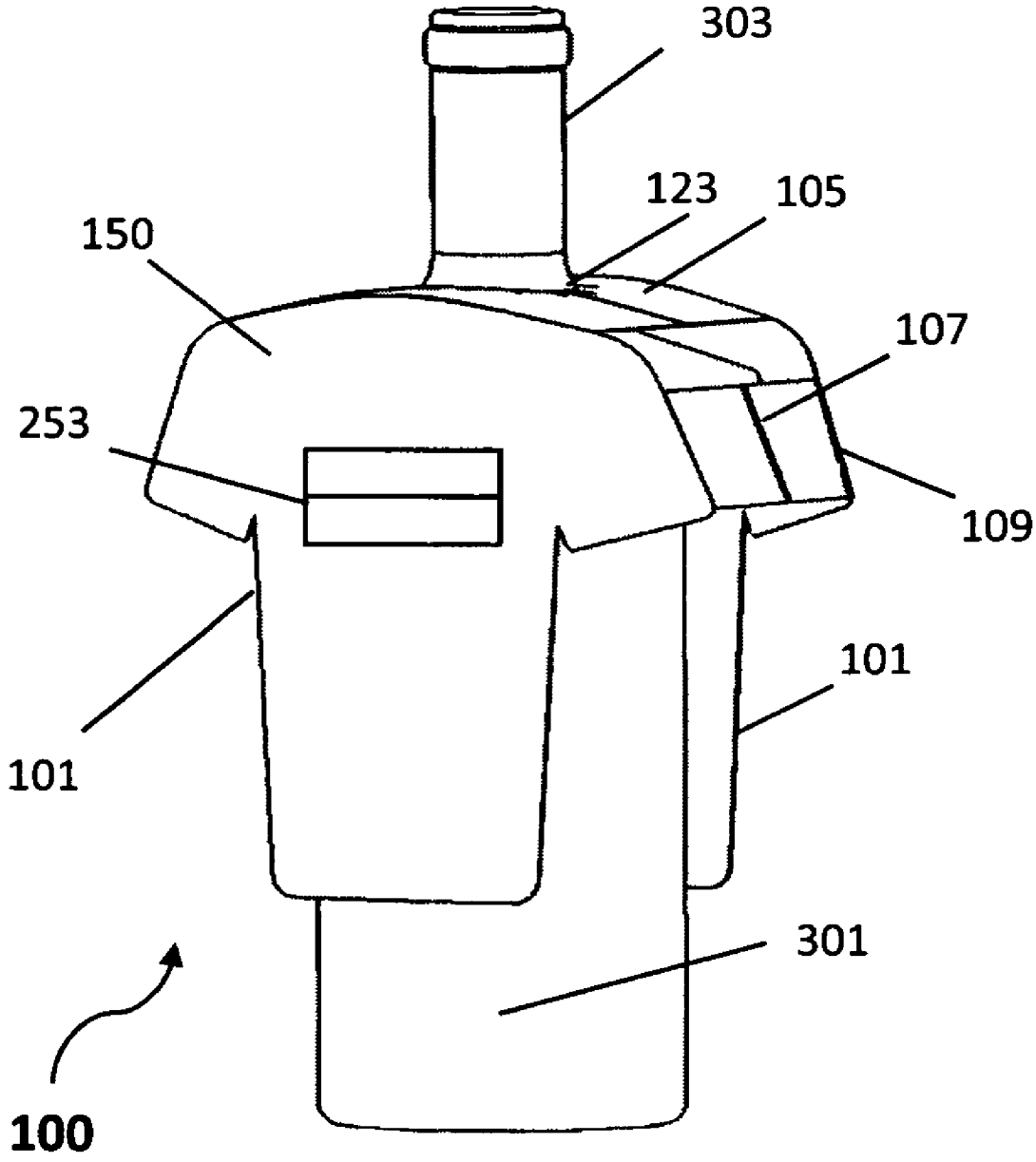
FIG. 3 is a block diagram illustrating a perspective view of the present invention with the orifice in the horizontal top panel inserted over the neck of the bottle in accordance with an exemplary embodiment of the present invention.

Shown in FIG. 3 is a perspective view of an exemplary embodiment of the present invention illustrating a fully assembled greeting card 100 inserted over the neck of a bottle 303 to be presented as a gift. For illustrative purposes the greeting card 101 is shaped in the form of a T-shirt design and the gift 301 is a wine bottle. The neck 303 of the wine bottle 301 is inserted into the T-shirt greeting card 101 through the cutout orifice 123. Before inserting the greeting card 100 over the neck of the wine bottle 301, it is unfolded along the major axis 107 by expanding the foldable slant section 109. Upon unfolding the T-shaped greeting card 100, the cutout orifice 123 formed on the top horizontal panel will be visible. During insertion of the T-shirt shaped greeting card over the neck 303 of bottle 301, the vertical panels 101 are kept in a downwards direction and top horizontal panel in an upward direction. The vertical panels 101 may be customized in a size short enough to display the label on the wine bottle 301. Alternatively, the vertical panels 101 may be constructed long enough to cover the label on the wine bottle.

Figure 4A:
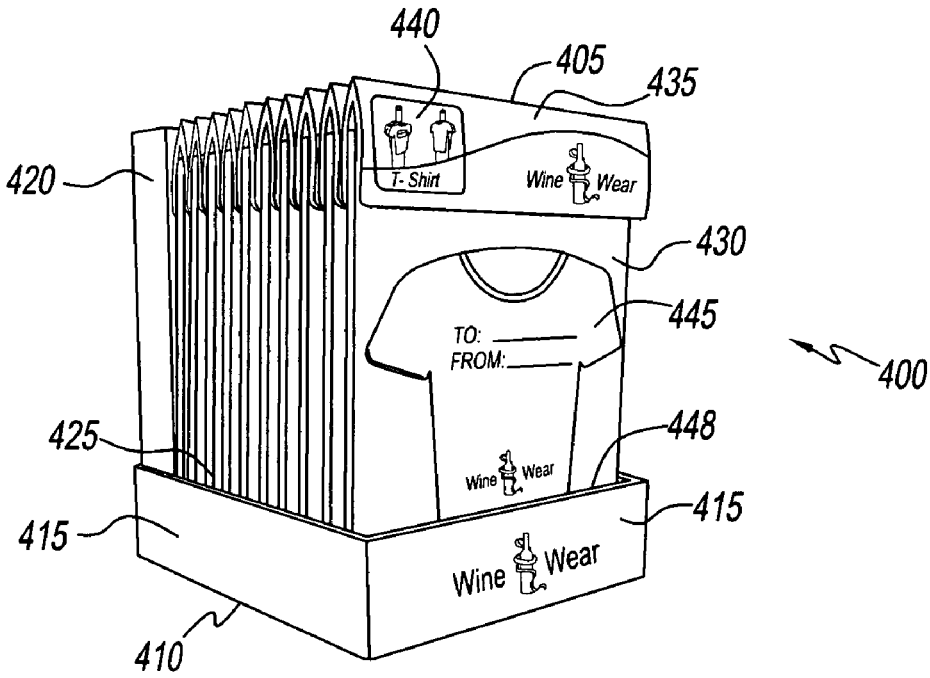
FIG. 4A is a block diagram illustrating a perspective view of a packaging object, in accordance with an exemplary embodiment of the present invention.

FIG. 4A is a block diagram illustrating a perspective view of a packaging system 400 in accordance with an exemplary embodiment of the present invention. The packaging system 400 includes a greeting card cover 405 holding the greeting card 100 and a crate 410. In one embodiment of the present invention, the greeting card cover 405 includes a lid 435 and a bag 430. The lid 435 has an adhesion strip around the inner boundary of the lid to adhere the bag 430 of the greeting card cover 405. The lid 435 further includes a printable surface 440 for inserting graphics and for advertising the type of greeting card it holds for instance, theme of the greeting card. The bag 430 includes a paper stiffening insert 448 for holding the greeting card in its proper shape and ensuring its integrity. The bag 430 is adapted to accommodate the greeting card within it. In one embodiment of the present invention, the bag 430 is made of a transparent plastic material or other suitable material. In one embodiment of the present invention, the greeting card cover 405 is rectangular in shape. The shape of the greeting cover 405 may vary based on the shape of the greeting card it is designed for.

In an exemplary embodiment of the present invention, the crate 410 is adapted for holding a plurality of greeting cards 100 in their respective greeting card covers 405 and is made of a cardboard or other suitable material. The crate 410 includes a horizontal bottom section 415 with a plurality of slots 425 for holding the plurality of greeting card covers 405 holding the greeting cards 100 within the crate 410. The crate 410 further includes a vertical side section 420 for displaying the greeting card covers 405. Together, the vertical side section 420 and the horizontal bottom section 415 display the greeting cards 100 in their greeting card covers 405.

Figure 4B:
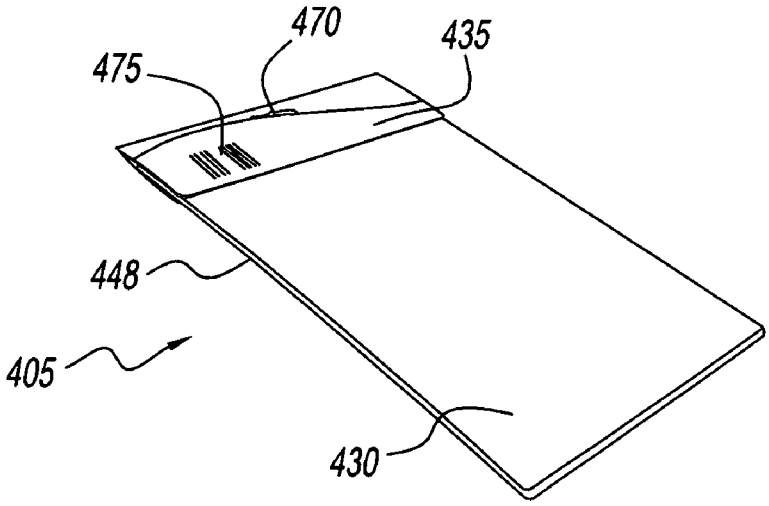
FIG. 4B is a block diagram illustrating a perspective view of the display box holding the greeting cards in their greeting covers in accordance with an exemplary embodiment of the present invention.

FIG. 4B is a block diagram illustrating a perspective view of a greeting card cover 405 in accordance with an exemplary embodiment of the present invention. The greeting card cover 405 includes a bag 430 and a lid 435. The bag 430 of the greeting card cover 405 further includes a stiffening insert 465 on the outer surface of the bag to firmly keep the greeting card in its proper shape and avoids distortion of the greeting card when it is stored in the crate 410. The stiffening insert 465 is printable, allowing the display of instructions or messages to the users. In one embodiment of the present invention, the lid 435 of the greeting card cover 405 includes a handle 470 in the middle of the lid 435 allowing the user to grasp the greeting card cover when removing it from the crate. The handle 470 may be circular or rectangular in shape with a chamfered edge. The lid 435 is printable, allowing the display of instructions or messages to the users. The lid 435 further includes a bar-code 475 printed on it to indicate the price of the greeting card 100. The lid 435 further includes an adhesion strip around the inner boundary to adhere to the bag 430 of the greeting cover 405. The adhesive strip may be a cellophane tape or pressure sensitive adhesive tape. In an exemplary embodiment of the present invention, the lid 435 is made of plastic, cloth, paper, cardboard, or other suitable material. The lid 435 may be rectangular, square, or curved in shape depending on the shape of the greeting card 100.

Figure 5:
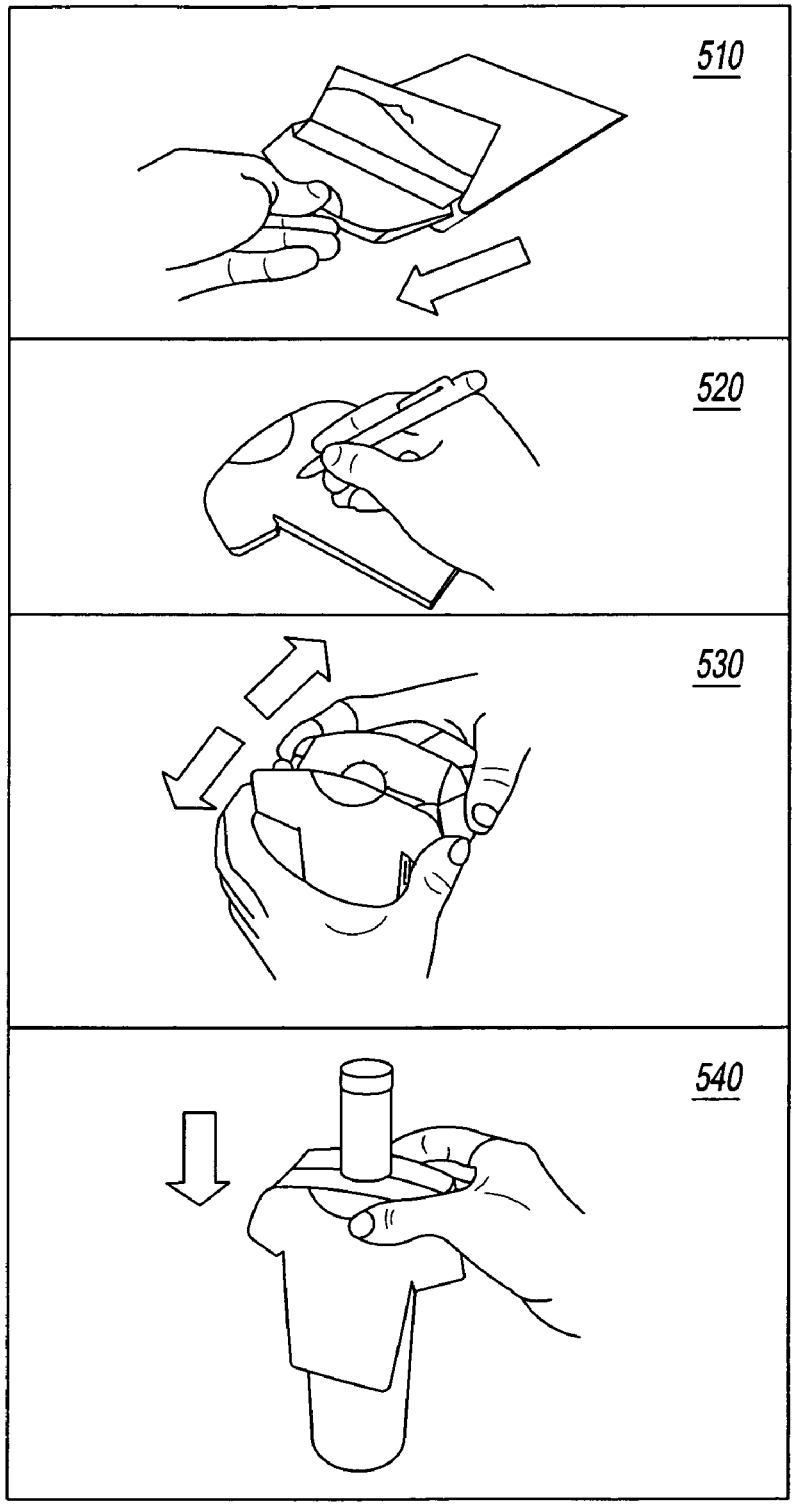
FIG. 5 is a flow diagram illustrating the method of removing a greeting card according to the present invention from its greeting cover, with an example showing the manner of inscribing a personal message according to one embodiment, assembling the greeting card, and inserting the orifice on the top horizontal panel of the card over the neck of a bottle.

FIG. 5 illustrates a method of removing a greeting card from a greeting cover and inserting it over a gift, in accordance with an exemplary embodiment of the present invention. A greeting card packaged within a greeting card cover is removed from the packaging bag as represented in step 510. The greeting card cover is removed by removing the lid of the greeting card cover, which is adhered to the bag of the greeting card cover. The greeting card cover is opened from the top (i.e. at the lid portion) and the greeting card is taken out from the packaging bag. For instance, if the greeting card is T-shirt shaped, the T-shirt shaped greeting card is taken out by the user in the direction as shown by the arrow in 510. Following the removal of the T-shirt shaped greeting card from the packaging bag, the user is permitted to write a personalized message on the greeting card as represented in step 520. The greeting card is then unfolded to insert over the gift. The greeting card is unfolded by expanding the top horizontal panel of the greeting card in opposite directions as shown by the arrows, in step 530. The greeting card is wrapped over the gift by inserting the cutout orifice of the top horizontal panel of the greeting card over the neck of the bottle gift as shown in step 540.

Having thus illustrated and described the principles of our invention through its various embodiments, it will be understood and obvious to one skilled in the art that the embodiments of the invention may be further modified without departing from the spirit and scope of the invention as set forth in the claims that follow.

What is claimed is:

1. A personally crafted greeting card adapted to insert over a gift comprising:

a top horizontal panel and; a plurality of vertical panels;

said top horizontal panel having at least one foldable curved section with a cutout orifice at the center of the said top horizontal panel;

said top horizontal panel having a foldable slant section seamlessly linked to the said foldable curved section;

said top horizontal panel having a major axis section;

an adhesive tape extended from at least one of the said foldable curved section down the said foldable slant section;

said plurality of vertical panels comprising;

a curved top edge section attached to the said adhesive tape extended from at least one of the said foldable curved section of the said top horizontal panel;

a slant top edge section attached to the said adhesive tape extended from the at least one of the said slant section of the said top horizontal panel; and at least one of a front surface and a one of a back surface on the said plurality of vertical panels having at least one of a graphics or a text message.

2. The greeting card as recited in claim 1, wherein the said major axis section traverses through the middle of the said foldable curved section, the said cutout orifice, and the said foldable slant section.

3. The greeting card described in claim 1, wherein the said foldable curved section and the said foldable slant section of the said top horizontal panel are foldable at the said major axis section through perforations in the said major axis section.

4. The greeting card as recited in claim 1, further comprising multiple relief cuts at the inside circumference of the said cutout orifice.

5. The greeting card as recited in claim 1 wherein the greeting card is unfolded at the said major axis section before inserting the gift.

6. The greeting card as recited in claim 1, wherein the said cutout orifice at the center of the said foldable curved section of said top horizontal panel is visible upon unfolding the said top horizontal panel at its said major axis section.

7. The greeting card as recited in claim 1, wherein the neck of a bottle is insertable in said cutout orifice at the center of said foldable curved section of the said top horizontal panel.

8. The greeting card as recited in claim 1, wherein the said cutout orifice at the center of the said foldable curved section of the said top horizontal panel is circular in shape.

9. The greeting card as recited in claim 8, wherein the diameter of the said circular cutout orifice is in a range from one inch to three inch.

10. The greeting card as recited in claim 1, wherein the said adhesive tape extended at the said foldable curved section and the said foldable slant section are separated by a space at the middle of the said top horizontal panel.

11. The greeting card as in claim 1, wherein the said adhesive tape is a double-sided pressure sensitive adhesive tape or cellophane tape.

12. The greeting card as recited in claim 1, wherein the said vertical panels are designed in a T-Shirt shape with at least one of a V-shaped neck portion, U-shaped neck portion, flat design at neck portion, and straight design at neck portion.

13. The greeting card as recited in claim 12, wherein the T-shirt shaped vertical panel comprises a curved top section which is shoulder section.

14. The greeting card as recited in claim 13, wherein the said shoulder section of T-shirt shaped vertical panel is aligned to adhere with the corresponding said foldable curved section of the said top horizontal panel.

15. The greeting card as recited in claim 14, wherein the T-shirt shaped vertical panel comprises said slanted top section which is an arm section.

16. The greeting card as recited in claim 15, wherein the said arm section of the T-shirt shaped vertical panel is aligned to adhere with the corresponding said foldable slant section of the said top horizontal panel.

17. The greeting card as recited in claim 1, wherein the said vertical panel and the said top horizontal panel are made of at least one of a cardboard paper, reinforced cloth, or flexible plastic.

18. The greeting card as recited in claim 1, wherein the said text message is a printed text message or a handwritten text message depicting at least one of a slogan, an emblem, or wishes for an event.

* * * * *